US006030264A

United States Patent [19]

Carter

[11] Patent Number: 6,030,264

[45] Date of Patent: Feb. 29, 2000

[54] FLOTATABLE LIGHTING ASSEMBLY

[75] Inventor: Ronald S. Carter, Akron, Ohio

[73] Assignee: The L.D. Kichler Company, Ohio

[21] Appl. No.: 09/240,175

[22] Filed: Jan. 29, 1999

[51] Int. Cl.[7] ..... B63B 22/00

[52] U.S. Cl. ..... 441/16; 43/17.5

[58] Field of Search ..... 441/1, 6, 11–18; 43/17.5

[56] References Cited

U.S. PATENT DOCUMENTS 3,464,139 9/1969 Eggers .
3,617,733 11/1971 Adams .
3,833,955 9/1974 Hulbert, Jr. .
3,893,201 7/1975 Mallory ..... 441/1
4,553,194 11/1985 Bailey .
5,133,145 7/1992 McDonald .
5,184,414 2/1993 Downs .
5,651,209 7/1997 Rainey .

*Primary Examiner*—Ed Swinehart
*Attorney, Agent, or Firm*—Watts, Hoffmann, Fisher & Heinke Co., LPA

[57] ABSTRACT

A Rotatable lighting assembly includes a base with a central concave wall that can face a liquid surface and a peripheral portion extending around the concave wall. A shell is constructed so as to extend from the peripheral portion to form a chamber around the concave wall that provides the lighting assembly with buoyancy. A lamp has a lower light-emitting portion and an electrical contact portion. The electrical contact portion is disposed in an interior region formed by the concave wall. Electrical wire is electrically connected to the contact portion of the lamp. Structure in the base directs electrical wire from a lower portion of the base into the liquid.

19 Claims, 3 Drawing Sheets

FLOTATABLE LIGHTING ASSEMBLY

FIELD OF THE INVENTION

The present invention relates to a flotatable lighting assembly and, in particular, to a lighting assembly powered by a remote power source.

BACKGROUND OF THE INVENTION

Various lighting assemblies have been constructed for use in water. Flotatable lighting assemblies are often used for providing a warning to boats and for attracting fish for fishing. In both cases the lighting assembly is typically made from a body comprised substantially of a buoyant material. Electrical wiring from a power source such as a battery enters the top or side of the lighting assembly. These designs avoid exposing the electrical connection between the lighting assembly and the wiring to water and generally avoid submerging the electrical wiring in the water.

One example of a flotatable lighting assembly is disclosed in U.S. Pat. No. 3,833,955. This lighting assembly employs a body formed of foamed polyurethane for providing it with buoyancy. The contact portion of the lamp is enclosed in the body and isolated from wetness. Electrical wiring enters the top of the lighting assembly.

SUMMARY OF THE INVENTION

In general, the present invention is a Rotatable lighting assembly comprising a base that includes a central concave wall that can face a liquid surface and a peripheral portion extending around the concave wall. A shell is constructed so as to extend from the peripheral portion to form a chamber around the concave wall that provides the lighting assembly with buoyancy. A lamp has a lower light-emitting portion and an electrical contact portion that is disposed in an interior region formed by the concave wall. Electrical wire is electrically connected to the contact portion of the lamp. Structure of the base directs the electrical wire from a lower portion of the base into the liquid.

More specifically, the peripheral portion is generally U-shaped in section. The shell is connected to the base as a separate member. A retaining ring is disposed around the light-emitting portion of the lamp and fastened to the base and an O-ring is disposed between the retaining ring and the lamp. A strain relief member is carried by the retaining ring. The peripheral portion of the base has a generally circular shape and the shell is generally dome shaped. The base and the shell are preferably formed of nonmetallic material. The shell and base may cooperate to form interlocking surfaces between which a water-resistant material is disposed. As a result of the interlocking joint and water-resistant material, the chamber is preferably water-tight and occupied by substantially only air for providing the lighting assembly with buoyancy. An electrically insulating, water submersible casing is disposed around a portion of the electrical wire that extends in the water. A low voltage transformer is electrically connected to the electrical wire.

A preferred embodiment of the flotatable lighting assembly of the invention comprises the base including a central concave wall that can face the liquid surface and the peripheral portion extending around the concave wall. The peripheral portion is generally U-shaped in section. The shell is constructed so as to extend from the peripheral portion to form a water-tight chamber around the concave wall, the chamber being occupied by substantially only air to provide the lighting assembly with buoyancy. The lamp is fastened to the base, the lamp including the lower light-emitting portion and having the electrical contact portion disposed in the interior region formed by the concave wall. The electrical wire is electrically connected to the contact portion of the lamp. A passageway is constructed and arranged in the base for directing the electrical wire from a lower portion of the base into the liquid.

The flotatable lighting assembly offers numerous advantages in design, safety and reliability. The present invention need not include a buoyant material in the chamber, but rather can utilize air to provide the lighting assembly with buoyancy, which reduces the cost of fabrication. The lighting assembly may employ a separate shell and base, which are bonded together to make the chamber water-tight. The foregoing features enable the lighting assembly to be fabricated easily and cost effectively by injection molding.

Using the low voltage transformer and the insulative casing around the wire provides the lighting assembly with safety and reliability. Because of the low voltage to which the lamp is exposed, the interior region that is formed by the concave wall need not be completely sealed from water. The passageway into the interior region need not be sealed and enables the lighting assembly to operate effectively and reliably even when there is wetness in the interior region. Finally, the electrical wire, being directed from the lower portion of the lighting assembly into the water, is less conspicuous to the observer. In addition, the wire is protected from entanglement and from damage by being disposed under the water.

Many additional features, advantages and a fuller understanding of the invention will be had from the accompanying drawings and the detailed description that follows.

DETAILED DESCRIPTION OF PREFERRED EMBODIMENTS

Figures 2, 2A:
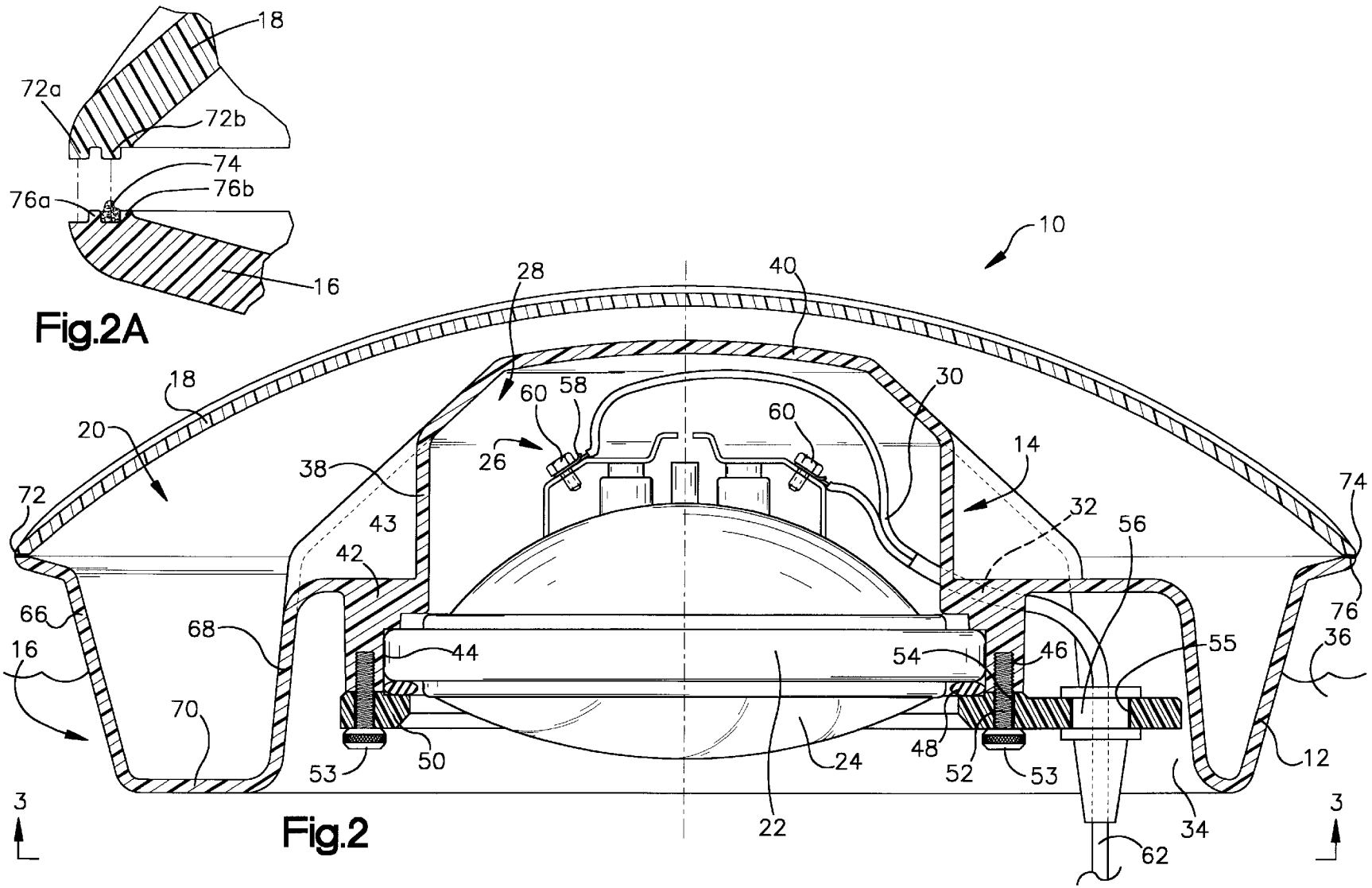
FIG. 2 is a cross-sectional view of the lighting assembly of FIG. 1.
FIG. 2A is an enlarged partial cross-sectional view of FIG. 2, which shows an interlocking joint that has been omitted from the other Figures for clarity.
Figure 3:
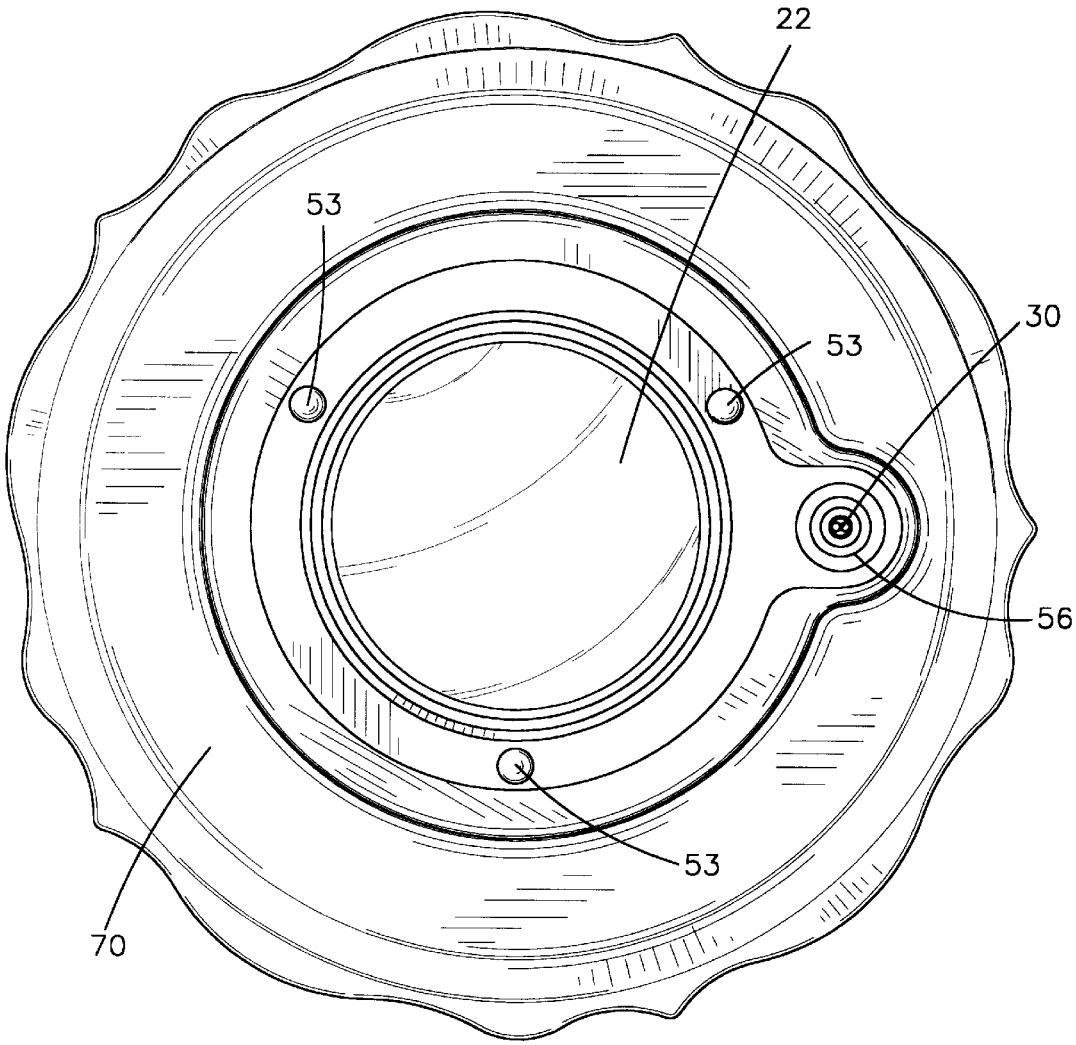
FIG. 3 is a view of the lighting assembly as seen in a direction designated by the lines 3—3 in FIG. 2.

Referring now to the drawings, a flotatable lighting assembly of the invention is shown generally at 10. The lighting assembly has a base 12 that includes a central concave wall 14 that can face a water surface and a peripheral portion 16 extending around the concave wall that is generally U-shaped in cross-section as seen in FIG. 2. A shell 18 forms a chamber 20 with the peripheral portion. A lamp 22 has a lower light-emitting end portion 24 and an electrical contact portion 26 that is disposed in an interior region 28 formed by the concave wall. Electrical wire 30 is electrically connected to the contact portion of the lamp. A passageway 32 in the base directs the electrical wire from a lower portion of the base 34 and into the water 36.

The concave wall 14 is generally cup-shaped as seen in FIG. 2 and comprises a side wall 38 and an end wall 40. A section 42 extends between the side wall and the peripheral portion. The section 42 includes a recess 44 configured so as to receive the profile 46 of the lamp.

The lamp is positioned so that its contact portion 26 extends in the interior region 28 with sufficient clearance so that the contact portion does not contact the end wall 40, and such that the lamp profile 46 is received by the recess 44. An O-ring 48 is placed around the lamp. The interior region is sized to avoid excessive heat concentration from the lamp onto the plastic of the base. The O-ring 48 is made of a suitable flexible material, for example, a 100% silicone O-ring as supplied by Vanguard Plastics. A retaining ring 50 is placed on the O-ring. The O-ring acts as a buffer to prevent movement of the lamp. Fasteners such as bolts and nuts are used to secure the retaining ring against the lamp. For example, exteriorly threaded studs 52 are molded into the section 42 of the base and are received in openings in the retaining ring. Interiorly threaded ball-shaped nuts 53 are threaded onto the studs against the retaining ring to securely fasten the lamp to the base. The retaining ring is preferably made of a nylon material, such as Zytel™ brand polymer by Dupont®. The base and shell may be formed of any suitable nonmetallic material, and are preferably comprised of plastic material such as ABS (acrylonitrile-butadiene-styrene) plastic or Zytel™ brand polymer by Dupont®.

The retaining ring 50 includes an opening 55 for receiving a strain-relief member, for example, strain relief member 56, for supporting the electrical wire. The passageway 32 directs the electrical wire from the interior region 28 to the lower end portion 34 of the base, inwardly of the peripheral portion 16, and into the water.

Electrical connectors 58 are fastened to one end of the electrical wire for electrically connecting the wire to the contact portion 26 of the lamp. The connectors 58 may be U-shaped spade terminals, for example, which are fastened to the contact portion of the lamp using screws 60. The electrical wire is UL listed wire approved for submersible fixtures. The portion of the wire that is disposed in the water includes a water resistant casing so as to form a cable 62. Suitable wire cable is 18/2 AWG type STW-A PVC water resistant power cord rated for 105° C.

The generally U-shape of the peripheral portion is formed by an exterior side wall 66, an interior side wall 68 and a lower surface 70. The shell has a lower peripheral surface 72. The shell is a separate dome-shaped member that is connected to the peripheral portion of the base in a suitable manner such as bonding. A suitable water-resistant material 74 is applied between the shell and the base. The base includes an upper peripheral surface 76 that has a generally circular shape from above. The surfaces 72 and 76 have an interlocking configuration to prevent water from entering the chamber 20. One suitable interlocking construction of the surfaces 72 and 76 is the dovetail joint-like configuration shown in FIG. 2A. Projections 76*a* from the base surface 76 form a female region 76*b* therebetween. Projections 72*a*, 72*b* extend from the shell, the projection 72*b* extending into the female region 76*b*. A bead of Dow® brand silicone No. 732 water-resistant adhesive 74 is applied between the female base region 76*b* and the shell projection 72*b* and the shell and base are fitted together. Those skilled in the art will appreciate in view of this disclosure that the location and arrangement of the projections and recess may be different, that the recess 76*b* may be formed in the shell and the projection 72*b* that engages it—in the base, and that other types of joints may be used. The interlocking construction prevents water from entering the chamber 20. The chamber is occupied substantially by only air for providing the lighting assembly with buoyancy. It is not necessary for the lighting assembly of the present invention to include a buoyant material in the chamber 20.

Figure 1:
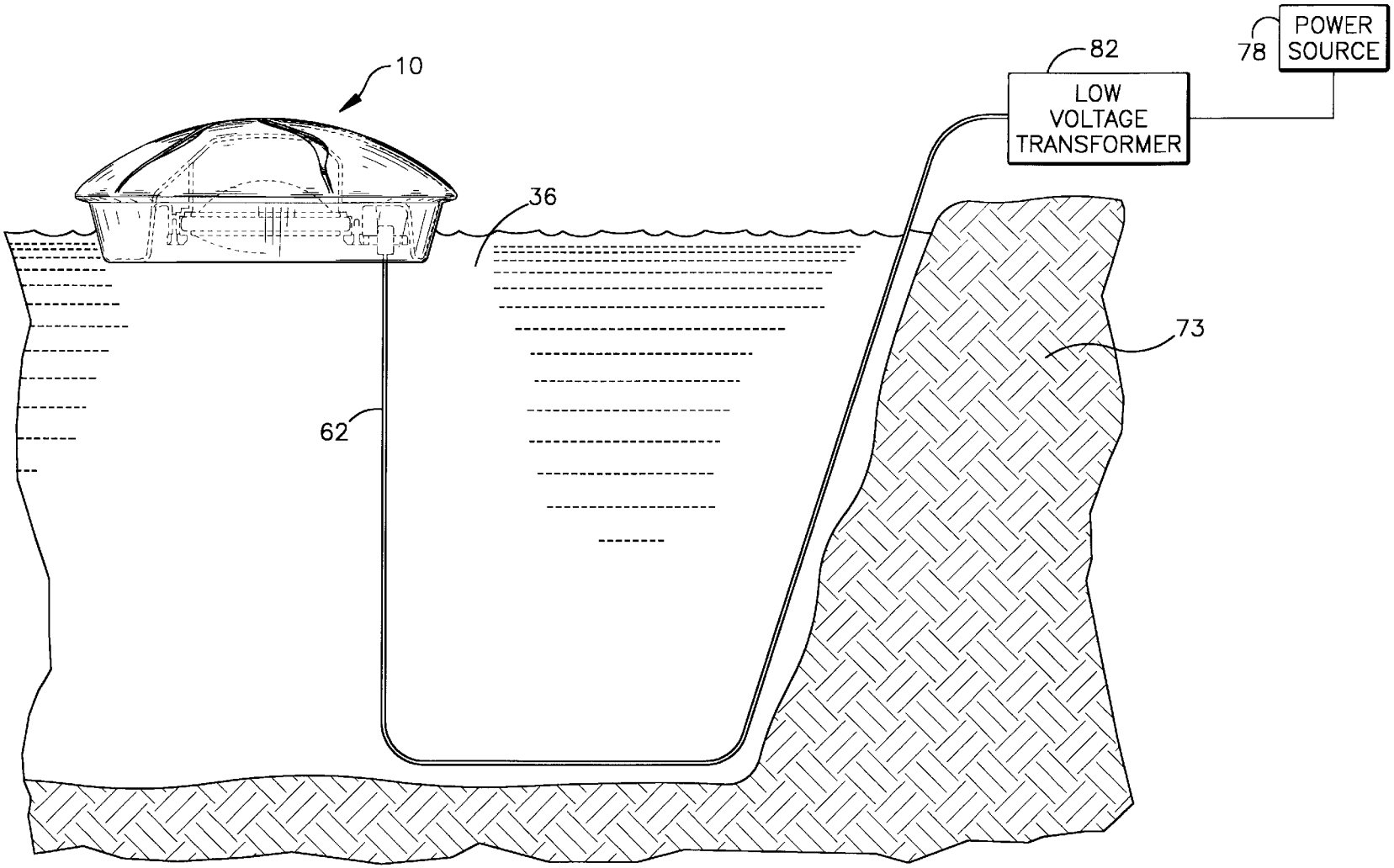
FIG. 1 is a view of a flotatable lighting assembly constructed in accordance with the present invention.

The water 36 may be contained in an area 73 such as a pond used in landscaping. As seen in FIG. 1, the electrical cable extends downwardly from the bottom of the base to the bottom of the pond and upwardly along the side wall of the pond to a location outside the pond. The lighting assembly may be tethered so as to remain at a generally fixed location on the water.

The electrical cable extends to the lighting assembly from a power source 78 such as 120 volt AC household current (120 V line voltage). From the power source the wire may be electrically connected to a low voltage transformer 82, for example, a 12 volt DC transformer. The transformer enables the lamp to be used in the wet environment without electrical hazard or shorting. Therefore, the electrical connector end of the lamp may be disposed in the interior region 28 and electrically connected to the wire even though the passageway 32 and thus, the interior region itself, are not sealed against water. The electrical terminals in the interior region 28 may get wet without loss of function of the lighting assembly or creating a hazard.

Only one lamp assembly (including the lamp, the base, the shell and the electrical wire as in FIG. 2) may be electrically connected to the wire, or additional lamp assemblies may be used. In the case of additional lamp assemblies, each lamp assembly would be separately electrically connected to the electrical wire and spaced from the other lamp assemblies. A single power source and low voltage transformer may be used with the multiple lamp assemblies.

Many modifications and variations of the invention will be apparent to those skilled in the art in light of the foregoing disclosure. Therefore, it is to be understood that, within the scope of the appended claims, the invention can be practiced otherwise than has been specifically shown and described.

What is claimed is:

1. A flotatable lighting assembly comprising:

a base including a central concave wall that can face a liquid surface and a peripheral portion extending around said concave wall;

a shell that is constructed so as to extend from said peripheral portion to form a chamber around said concave wall that provides said lighting assembly with buoyancy;

a lamp having a lower light-emitting portion and an electrical contact portion, said electrical contact portion being disposed in an interior region that is formed by said concave wall;

electrical wire that is electrically connected to said contact portion; and structure in the base for directing said electrical wire from a lower portion of said base into the liquid.

2. The flotatable lighting assembly of claim 1 wherein said peripheral portion is generally U-shaped in section.

3. The flotatable lighting assembly of claim 1 wherein said shell is a separate member that is connected to said base.

4. The flotatable lighting assembly of claim 1 comprising a retaining ring disposed around said light-emitting portion of said lamp and fastened to said base, and an O-ring disposed between said retaining ring and said lamp.

5. The flotatable lighting assembly of claim 4 comprising a strain relief member carried by said retaining ring.

6. The flotatable lighting assembly of claim 1 wherein said peripheral portion has a generally circular shape.

7. The flotatable lighting assembly of claim 1 wherein said shell is generally dome shaped.

8. The flotatable lighting assembly of claim 1 wherein said chamber is water-tight.

9. The flotatable lighting assembly of claim 1 wherein said chamber is occupied by substantially only air for providing said lighting assembly with buoyancy.

10. The flotatable lighting assembly of claim 1 comprising an electrically insulating, water submersible casing disposed around a portion of said electrical wire that is disposed in the liquid.

11. The flotatable lighting assembly of claim 1 wherein said base is formed of nonmetallic material.

12. The flotatable lighting assembly of claim 1 wherein said shell is formed of nonmetallic material.

13. The Rotatable lighting assembly of claim 1 comprising a low voltage transformer electrically connected to said electrical wire.

14. The flotatable lighting assembly of claim 1 wherein said concave wall is generally cup-shaped.

15. The Rotatable lighting assembly of claim 1 comprising an interlocking structure formed by cooperating surfaces of said peripheral portion and said shell.

16. A flotatable lighting assembly comprising:

a base including a central concave wall that can face a liquid surface and a peripheral portion extending around said concave wall, said peripheral portion being generally U-shaped in section;

a shell constructed so as to extend from said peripheral portion to form a water-tight chamber around said concave wall, said chamber being occupied by substantially only air to provide said lighting assembly with buoyancy;

a lamp having a lower light-emitting portion and an electrical contact portion, said electrical contact portion being disposed in an interior region formed by said concave wall;

electrical wire that is electrically connected to said contact portion; and a passageway constructed and arranged in the base for directing said electrical wire from a lower portion of said base into the liquid.

17. The lighting assembly of claim 16 comprising a retaining ring disposed around said light-emitting portion of said lamp and fastened to said base; an O-ring disposed between said retaining ring and said lamp and a strain relief member carried by said retaining ring for supporting said electrical wire.

18. The flotatable lighting assembly of claim 16 comprising a low voltage transformer electrically connected to said electrical wire.

19. The flotatable lighting assembly of claim 16 comprising an electrically insulating, water submersible casing disposed around a portion of said electrical wire that is disposed in the water.

* * * * *